United States Patent [19]

Hori

[11] Patent Number: 4,542,586

[45] Date of Patent: Sep. 24, 1985

[54] METHOD FOR CUTTING OUT A FRONT PART OF CLOTHING

[76] Inventor: Yuka Hori, 8-39, Hamatake 4-Chome, Chigasaki-shi, Kanagawa, 253, Japan

[21] Appl. No.: 584,939

[22] PCT Filed: May 26, 1983

[86] PCT No.: PCT/JP83/00163

§ 371 Date: Jan. 24, 1984

§ 102(e) Date: Jan. 24, 1984

[87] PCT Pub. No.: WO83/04165

PCT Pub. Date: Dec. 8, 1983

[30] Foreign Application Priority Data

May 28, 1982 [JP] Japan ..... 57-89824

[51] Int. Cl.[4] ..... A41H 3/06

[52] U.S. Cl. ..... 33/12; 33/17 R

[58] Field of Search ..... 33/12, 13, 14, 17 R, 33/17 A

[56] References Cited

U.S. PATENT DOCUMENTS 3,803,717 4/1974 Mrak ..... 33/12

4,222,170 9/1980 Koontz ..... 33/17 R

FOREIGN PATENT DOCUMENTS 848391 10/1939 France ..... 33/17 R 971825 1/1951 France ..... 33/12

619199 3/1961 Italy ..... 33/12

*Primary Examiner*—Richard R. Stearns

*Attorney, Agent, or Firm*—Kramer and Brufsky

[57] ABSTRACT

This is a method of cutting out a front part of clothing and the like. A human body is drawn as a flat stereoscopic projection without breasts, then a basic original pattern piece (1) used as a body form is divided into a plurality of segments $a_1$, $a_2$, $a_3$, $a_4$ along a plurality of cutting lines (13, 14, 15, 16) toward the periphery from a bust point BP as the center, the segments $a_1$, $a_2$, $a_3$, $a_4$ are moved in response to measured personal dimensions and are placed so as to conform to the clothing of the design required. The profile of the figure is then used to obtain pattern pieces $X_1$, $X_2$, $X_3$ for the front, and the cloth is cut out using the pattern pieces. When clothing of a design having darts is fabricated, triangular notches (18, 21, 23) are formed in the pattern pieces $X_1$, $X_2$, $X_3$ to obtain darts (19, 20, 22) at the desired cutting positions indicated by the cutting lines (13, 14, 15, 16) and these are cut out.

2 Claims, 7 Drawing Figures

METHOD FOR CUTTING OUT A FRONT PART OF CLOTHING

DESCRIPTION

1. Technical Field

This invention relates to a method for cutting out a front part of clothing and more particularly, to a method to make an accurate pattern simply, easily and speedily when fabricating clothing of a desired design based upon a basic original pattern of a human body form, whereby any clothing fit for any human body form can be fabricated without fitting. Further, the method saves sewing time and cost.

2. Background Art

Conventional methods for cutting out clothing material include a flat cutting method, a stereoscopic projection method and a method utilizing these two methods together. Any one of the foregoing three methods requires complicated and skillful techniques based on fitting and revision. Further, it is very difficult to make a pattern completely suitable for each human body.

The stereoscopic projection method cuts out material stereoscopically by using an artificial human model more superior than the flat cutting method. However, since there are differences between the artificial human model and each person's real body form, the inconvenience of the stereoscopic projection method is that it requires very skillful and difficult cutting correction or revision. In addition, another inconvenience is that it must make the pattern while putting cloth or paper on the artificial human body, so that short-time and efficient cutting is unattainable. From this point of view, the present invention has a general object to provide a method for cutting out a front part of clothing which can make a pattern universally fit to each person's body form without any cumbersome work such as fitting and fabricating the clothing.

DISCLOSURE OF INVENTION

This invention provides a method for cutting out a front part of clothing by means of the following steps. A human body is first drawn as a flat stereoscopic projection having neither convex nor concave surfaces. After this, the necessary number of cutting lines toward the periphery from a center position (a bust point) of a breast of a basic original pattern are made and the cutting lines corresponding to the protruded form of the breast are cut out and open. Thus, a desired pattern is obtained, in compliance with which a material for sewing clothing is cut.

According to another aspect of this invention, the thus formed cutting lines are provided with at least one triangular notch. Thus, when cutting out the material based upon such pattern and joining the cut materials (or segments) by sewing, it is possible to fabricate clothing having darts at the desired cutting portions indicated by the cutting lines.

BEST MODE FOR CARRYING OUT THE INVENTION

Figure 1:
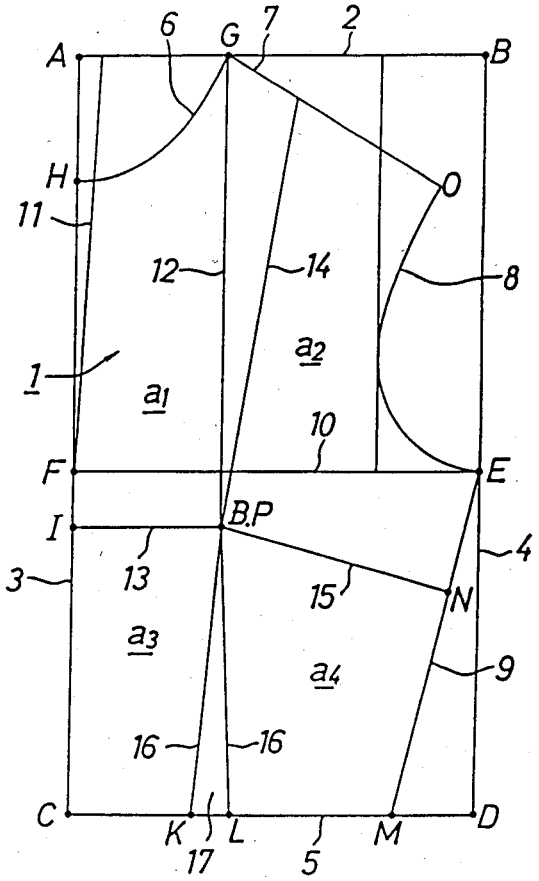
FIG. 1 is a plan view of a basic original pattern of a front part of clothing according to this invention.

Preferred examples of this invention will now be described with reference to the accompanying drawings.

First of all, a method for making a basic original pattern 1 of a front part of a garment will now be described. Numeral 2 is a lateral standard line having two end points A, B. Numerals 3 and 4 are body length lines starting from the points A and B. Numeral 5 is a waist line having two end points C and D corresponding to the points A and B.

A curved line G-H is a front neck line 6. A sloped line G-O is a front shoulder line 7. Further, a further curved line O-E is a front sleeve line 8. An oblique line E-M extending to the waist line 5 is a side line 9. A proper breast line 11 is formed between the uppermost line 2 and a center line 10 in parallel therewith.

Thus, an external profile of the basic original pattern 1 is formed.

Figure 2A:
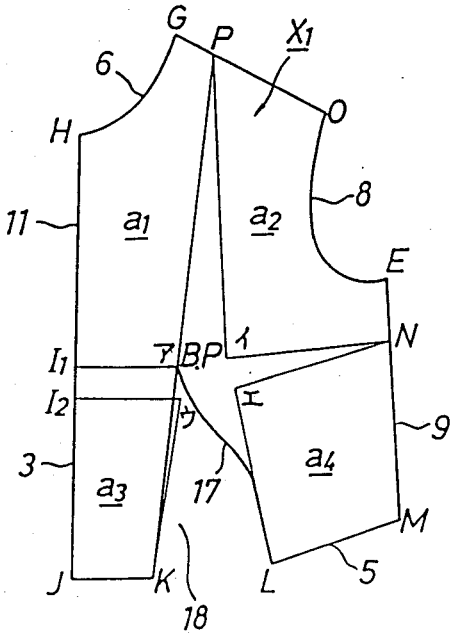
FIGS. 2A, 3A and 4A are plan views of three patterns for obtaining respectively three garments as illustrated in FIGS. 2B, 3B and 4B, respectively.

A breast line 12 starting from an intersecting point G between the front neck line 6 and the front shoulder line 7 extends to a bust point BP. Height line 3(A-C) is formed just between two bust points BP, namely symbol I is a mid point of a distance l (not illustrated) between the two bust points. Five lines i.e. three lines 13, 14, 15 and two lines 16, 16 are cut out by scissors or a cutter from the bust point BP. Thus, four segments $a_1$, $a_2$, $a_3$ and $a_4$ are formed as shown in FIG. 2A. Then, an acute-angled triangular part 17 is cut off.

How to make and cut out a pattern will now be described hereinafter.

Figure 2B:
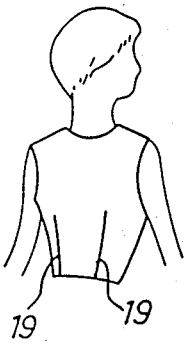
FIGS. 2B, 3B and 4B respectively are perspective views of garments which have been sewn by cutting out the respective patterns shown in FIGS. 2A, 3A and 4A, respectively.

FIG. 2A is a pattern view for obtaining a garment as designed in FIG. 2B. The four segments $a_1$, $a_2$, $a_3$ and $a_4$ are opened by cutting at [illegible] point of the breast point BP and other three points [illegible], [illegible] and [illegible]. And, a distance between the point [illegible] and the point [illegible] is widened by taking a front height from a back height. Further, a distance between the point [illegible] and the point [illegible] is widened by taking a distance between two shoulder joints from one-half of a bust, thereby the four segments $a_1$, $a_2$, $a_3$ and $a_4$ are disposed as shown in FIG. 2A so that the point [illegible] may be positioned on a line N-[illegible].

Further, a bulged breast line 17 between the point [illegible] and the point L is drawn, thereby a triangular part 18 is formed by connecting the points L, [illegible], K. Thus, a pattern $X_1$ can be formed by connecting the points G→H→$I_1$→$I_2$→J→K→[illegible]→L→M→N→E→O→P→G all together. When a material is cut out and sewn on the basis of the pattern $X_1$, a garment having two darts 19, 19 at the desired cutting portion 18 of the pattern $X_1$ can be fabricated as shown in FIG. 2B.

Figure 3A:
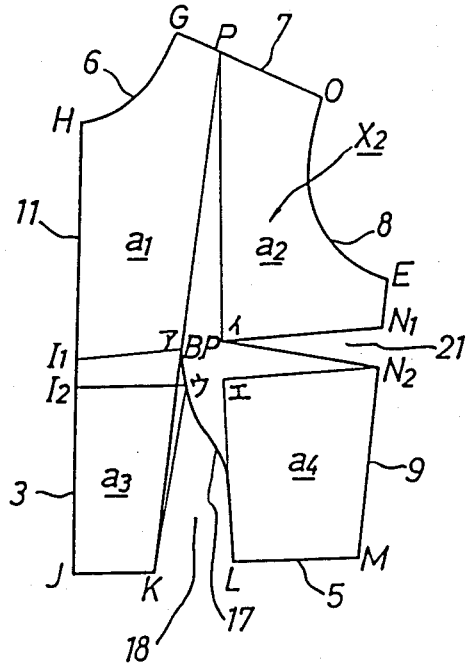
Figure 3B:
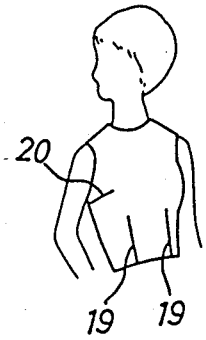

FIG. 3A is a plan view of a pattern $X_2$ having a dart 20 at the breast side as shown in FIG. 3B. The position of the points [illegible] and [illegible] is the same as shown in FIG. 2A. The point [illegible] is positioned on the same level of the line $I_2$-[illegible]. Further, a line [illegible]-$N_2$ and a line [illegible]-$N_1$ are disposed in parallel with each other. The bulged breast line 17 is also drawn likewise in the former example. Further, a second triangular part 21 is formed by connecting the points $N_1$→[illegible]→$N_2$. Thus, the pattern $X_2$ can be formed by connecting the points G→H→$I_1$→$I_2$→J→K→[illegible]→L→M→$N_2$→[illegible]→$N_1$→E→O→P→G all together. When a material is cut out and sewn on the basis of the pattern $X_2$, a garment having the two darts 19, 19 and a side dart 20 can be fabricated as shown in FIG. 3B.

Figure 4A:
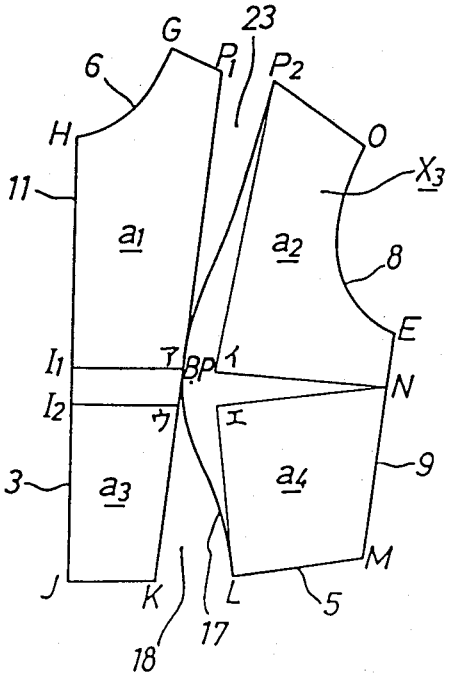
Figure 4B:
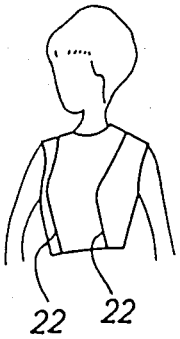

FIG. 4A is a plan view of a pattern $X_3$ having two princesslines 22, 22 as shown in FIG. 4B. The segments $a_1$ and $a_2$ are positioned as shown in FIG. 2A. The segment $a_2$ is separated from the segment $a_1$ and the both segments $a_1$ and $a_2$ are disposed in approximate parallel relation with each other. An upper bulged breast line communicating with the lower bulged breast line 17 is drawn in order to form the princessline 22. Thus, a pattern $X_3$ can be formed by connecting the points $G \rightarrow H \rightarrow I_1 \rightarrow I_2 \rightarrow J \rightarrow K \rightarrow$ [illegible] $\rightarrow L \rightarrow M \rightarrow N \rightarrow E \rightarrow O \rightarrow P_2 \rightarrow$ [illegible] $\rightarrow P_1 \rightarrow G$ all together. Accordingly, when material is cut out and sewn on the basis of the pattern $X_3$, a garment having the two princesslines 22, 22 can be fabricated as shown in FIG. 4B.

INDUSTRIAL APPLICABILITY

As described above, the method for cutting out a front part of clothing according to this invention can be used to make and cut out a desired pattern easily and speedily, thereby obtaining the clothing well matched to any person's body form without any cumbersome work, such as fitting. Thus, the present invention may be applied for the fabrication of various garments, including men's suits, women's suits and children's suits. In addition, so as to conform to a protruding portion of the breast, a plurality of segments can be opened by cutting toward the periphery from the bust point as the center, thereby suitable clothing fit to the form of the breast can be fabricated. Thus, this invention is very useful, particularly for the fabrication of women's garments.

I claim:

1. A method for cutting out a front part of clothing, wherein a human body is first drawn as a flat stereoscopic projection without a protruded portion of a breast and an external profile of a basic original pattern is made out by drawing a front neck line, a front shoulder line, a front sleeve line, a waist line and a proper breast line, and further forming at least four cutting lines toward the periphery of said profile from a bust point of the breast of the basic original pattern cutting said cutting lines and removing at least one cut portion so as to conform the pattern to the protruded portion of the breast, thereby forming a desired pattern with which a clothing material can be cut out.

2. The method for cutting out a front part of clothing as claimed in claim 1, wherein the cutting lines are positioned in order to obtain darts at the desired cut portions, thereby at least one acute-angled triangular part being formed on the pattern and subsequently cut off.

* * * * *